US009950889B2

(12) United States Patent
Higeta

(10) Patent No.: US 9,950,889 B2
(45) Date of Patent: Apr. 24, 2018

(54) FILM INTERMITTENT CARRYING DEVICE AND FILM INTERMITTENT CARRYING METHOD

(75) Inventor: Yuji Higeta, Fukushima-ken (JP)

(73) Assignee: Nittoku Engineering Co., Ltd, Saitama (JP)

( * ) Notice: Subject to any disclaimer, the term of this patent is extended or adjusted under 35 U.S.C. 154(b) by 623 days.

(21) Appl. No.: 13/523,218

(22) Filed: Jun. 14, 2012

(65) Prior Publication Data

US 2013/0119182 A1 May 16, 2013

(30) Foreign Application Priority Data

Nov. 15, 2011 (JP) ..... 2011-249209

(51) Int. Cl.
*B65H 18/14* (2006.01)
*B65H 20/24* (2006.01)

(52) U.S. Cl.
CPC ..... *B65H 18/145* (2013.01); *B65H 20/24* (2013.01); *B65H 2301/4491* (2013.01); *B65H 2301/4493* (2013.01); *B65H 2406/15* (2013.01); *B65H 2408/2171* (2013.01); *B65H 2511/112* (2013.01); *B65H 2511/142* (2013.01); *B65H 2511/212* (2013.01); *B65H 2513/11* (2013.01); *B65H 2555/24* (2013.01); *B65H 2801/61* (2013.01)

(58) Field of Classification Search
CPC ..... B65H 18/145; B65H 2301/4493; B65H 2408/2171; B65H 2511/112; B65H 2511/2129
USPC ... 242/412, 412.1, 412.2, 412.3, 413.3, 419, 242/419.1, 419.8, 420, 420.5, 420.6
See application file for complete search history.

(56) References Cited

U.S. PATENT DOCUMENTS 1,687,339 A * 10/1928 Lewellen ..... 226/41
2,945,637 A * 7/1960 Derrick ..... B65H 23/1806 226/195
2,988,294 A * 6/1961 Neff ..... 242/334.6
3,135,159 A * 6/1964 Fabregat ..... G03B 1/18 226/196.1

(Continued)

FOREIGN PATENT DOCUMENTS

JP 2002-003039 1/2002
JP 2012-012192 1/2012

*Primary Examiner* — Michael E Gallion
(74) *Attorney, Agent, or Firm* — Laurence A. Greenberg; Werner H. Stemer; Ralph E. Locher

(57) ABSTRACT

A film intermittent carrying device: includes a film delivering mechanism, a delivering and accumulating mechanism, accumulating the film and discharging the film, a winding and accumulating mechanism accumulating the film while discharging in an amount corresponding to an amount of the film discharged, and a film winding mechanism taking-up the film constantly. The delivering and accumulating mechanism includes first and second fixed rollers, an upstream-side movable roller moving to pass through a middle position between the first and second fixed rollers, and an upstream-side friction preventive unit configured to reduce a friction between the film and the upstream-side movable roller. The winding and accumulating mechanism includes third and fourth fixed rollers, and a downstream-side movable roller moving to pass through the middle position between the third and fourth fixed rollers, and a downstream-side friction preventive unit configured to reduce a friction between the film and the downstream-side movable roller.

4 Claims, 6 Drawing Sheets

27 COMPRESSED AIR SUPPLY PUMP
(UPSTREAM-SIDE FRICTION PREVENTIVE UNIT, DOWNSTREAM-SIDE FRICTION PREVENTIVE UNIT, AND CARRYING-SIDE FRICTION PREVENTIVE UNIT)

(56) References Cited

U.S. PATENT DOCUMENTS

| | | | | | |
|---|---|---|---|---|---|
| 3,155,339 | A * | 11/1964 | Groenewegen | 242/413.5 | |
| 3,280,393 | A * | 10/1966 | Crossley | B65H 23/044 | 242/420.6 |
| 3,318,547 | A * | 5/1967 | Bejach | 242/334.6 | |
| 3,375,963 | A * | 4/1968 | Wang et al. | 226/97.2 | |
| 3,540,671 | A * | 11/1970 | Moehle | 242/421.5 | |
| 3,540,674 | A * | 11/1970 | Okamura | 242/147 R | |
| 3,674,221 | A * | 7/1972 | Riemersma | 242/412.2 | |
| 4,261,786 | A * | 4/1981 | Martin et al. | 156/406 | |
| 4,360,137 | A * | 11/1982 | Noe | B21C 49/00 | 226/118.2 |
| 4,461,432 | A * | 7/1984 | Hutzenlaub | B65H 23/044 | 226/196.1 |
| 4,572,451 | A * | 2/1986 | Ikeda | B65H 19/28 | 242/527.3 |
| 5,190,234 | A * | 3/1993 | Ezekiel | B65H 19/14 | 156/157 |
| 5,505,401 | A * | 4/1996 | Lamothe | B65H 16/106 | 242/412.2 |
| 5,697,573 | A * | 12/1997 | Fukuchi | B65H 20/32 | 242/412.2 |
| 6,250,581 | B1 * | 6/2001 | Cramer | B65H 18/20 | 226/95 |
| 6,676,062 | B1 * | 1/2004 | Herhaus | 242/417 | |
| 7,067,039 | B2 * | 6/2006 | Almi et al. | 162/193 | |
| 8,302,900 | B2 * | 11/2012 | Gambini | B65H 19/2269 | 242/532.2 |
| 2008/0218905 | A1 * | 9/2008 | Biskeborn et al. | 360/130.21 | |
| 2011/0049210 | A1 * | 3/2011 | Kameda | A61F 13/15764 | 226/46 |
| 2011/0095121 | A1 * | 4/2011 | Awata et al. | 242/412.1 | |

* cited by examiner

FILM INTERMITTENT CARRYING DEVICE AND FILM INTERMITTENT CARRYING METHOD

CROSS-REFERENCE TO RELATED APPLICATION

This application claims the priority, under 35 U.S.C. § 119, of Japan patent application JP 2011-249209, filed Nov. 15, 2011; the prior application is herewith incorporated by reference in its entirety.

BACKGROUND OF THE INVENTION

Field of the Invention

The present invention relates to a film intermittent carrying device and a film intermittent carrying method capable of intermittently carrying a long film.

In a printing industry, printing is performed in such a way that a film to be printed is carried and is thereafter set to be rest once for applying predetermined printing to the rested film, and thereafter the rested film is printed again. Such a printing technique has been used for manufacturing a solar battery, flat panel display (FPD) and Monolithic Ceramic Chip Capacitor (MLCC), etc. In a case of applying predetermined processing such as printing to the film, it is a publicly-known matter to intermittently carry the film at constant intervals. Conventionally known film intermittent carrying device is configured to include a wind-off side for delivering a predetermined amount of film, and a winding-side provided separately from the wind-off side for winding the predetermined amount of film that has undergone predetermined processing such as printing (for example, see Japanese Patent Application Laid-Open No. 2002-3039 (paragraph [0003], and FIG. 1, FIG. 7)).

The film intermittent carrying device thus configured, includes a wind-off film roll around which a film to be printed is wound and a wind-off roller for drawing the film from the wind-off film roll and delivering this film at a wind-off side, and includes a winding roller for taking-up the film delivered from the wind-off roller, and a winding film roll formed of the actually wound film. In such a film intermittent carrying device, the film drawn from the wind-off film roll at the wind-off side, is delivered by the wind-off roller, and is subjected to predetermined printing, etc., and is then passed through the winding roller at the winding-side and is actually taken-up by the winding roller, to become the winding film roll. Then, the wind-off roller and the winding roller are intermittently driven by a motor, and with such an intermittent drive of the rollers, the wind-off film roll at the wind-off side and the winding film roll at the winding-side are also simultaneously rotated. Thus, according to the conventional intermittent film device, the film is intermittently carried as described above.

However, in the aforementioned film intermittent carrying device, not only the wind-off roller and the winding roller, but also the wind-off film roll and the winding film roll, are rotated intermittently by the motor, thus involving a problem to be solved, such as a failure in a speedy intermittent rotation of the wind-off film roll and the winding film roll, and there is a limit in increasing a carrying speed of the film which is intermittently carried.

That is, although the film is prepared at the wind-off side in a state of being wound into a roll shape, a weight of the wind-off film roll exceeds 100 kg in a case that a the wind-off film roll has an outer diameter of 40 to 60 cm in its size and is formed of a film having a width of 1 m to 1.6 m. Further, even in a case of the winding film roll at the winding-side, which is formed of the film delivered from the wind-off film roll as described above, the weight thereof exceeds 100 kg finally. Then, in order to increase the carrying speed of the film, there is a need for speedily and repeatedly perform rotation and stop of the wind-off film roll and the winding film roll. However, if the weights of the wind-off film roll and the winding film roll are taken into consideration, great inertia is generated. Therefore, even if a huge motor having a considerably large driving force is used, there is a certain limit in sudden acceleration or sudden deceleration in the rotation of the wind-off film roll and the winding film roll, and is also there is a limit in increasing the carrying speed of the intermittently carried film.

Further, even in a case of the wind-off roller for drawing and delivering the film from the wind-off film roll, and the winding roller for guiding this film to the winding film roll, they also have the inertia respectively. Therefore, even in a case of the wind-off roller and the winding roller, it is difficult to suddenly rotate the roller from a stopped state or immediately stop the roller from a rotated state. Accordingly, when the carrying speed of the film is increased, which is the film intermittently carried in a state of being wound around an outer periphery of the wind-off roller and the winding roller, difference is generated between a speed on the outer periphery of the rollers where sudden acceleration and sudden deceleration are difficult, and the carrying speed of the film which is wound around the outer periphery of the rollers and is suddenly accelerated and suddenly decelerated, thus generating a friction between the outer periphery of the rollers and the film by rubbing of the film against the outer periphery of the rollers, and generating scratches on the film by this friction in some cases.

SUMMARY OF THE INVENTION

An object of the present invention is to provide a film intermittent carrying device and a film intermittent carrying method capable of sufficiently increasing a carrying speed of a film without allowing scratches, etc., to be generated on the film which is intermittently carried.

The present invention provides a film intermittent carrying device, including: a film delivery mechanism of delivering a film constantly at a specified rate; a delivering and accumulating mechanism of gradually accumulating the film delivered from the film delivery mechanism and discharging this film in a short period of time; a winding and accumulating mechanism of accumulating the film in a short period of time while simultaneously discharging this film by the delivering and accumulating mechanism, with the film being discharged in an amount corresponding to an amount of the film discharged by the delivering and accumulating mechanism in a short period of time; and a film winding mechanism of taking-up the film constantly at a specified rate, with the film being gradually discharged from the winding and accumulating mechanism.

The delivering and accumulating mechanism further includes: first and second fixed rollers provided along a carrying route of the film; an upstream-side movable roller that can be moved in a direction perpendicular to the carrying route of the film while passing through a middle position between the first and second fixed rollers and; and an upstream-side friction preventive unit not allowing a friction to occur between the film wound around the upstream-side movable roller, and the upstream-side movable roller, and the winding and accumulating mechanism further includes: third and fourth fixed rollers provided along the carrying route of the film; a downstream-side movable roller that can be moved in the direction perpendicular to the carrying route of the film while passing through the middle position between the third and fourth fixed rollers; and a downstream-side friction preventive unit not allowing the friction to occur between the film wound around the downstream-side movable roller and the downstream-side movable roller.

In this case, it is also acceptable that either second or third fixed roller or both of them are formed rotatable with the film adsorbed thereon, and a winding servo motor is used to rotate either the second or third fixed roller or both of them with the film adsorbed thereon. When one of the second and third fixed rollers is configured to adsorb the film thereon and is rotatable, it is further preferable to provide a carrying-side friction preventive unit, which does not allow the friction to occur between the film wound around the other one of the second and the third fixed rollers, and the other one of the second and the third fixed rollers. Meanwhile, a carrying-side friction preventive unit not allowing the friction to occur can be provided in addition, between the film wound around the second and third fixed rollers, and the second and third fixed rollers.

Further, the friction preventive unit is preferably a compressed air supply pump for floating the film which is wound around the roller, by supplying compressed air to the roller, and the friction preventive unit may be the servo motor for rotating the roller so that a speed on the outer periphery of the rotating roller coincides with a carrying speed of the film which is wound around the roller.

Further, the present invention provides a film intermittent carrying method, including: gradually accumulating a film delivered by a film delivery mechanism constantly at a specified rate, and discharging this film in a short period of time, and repeating this process by a delivering and accumulating mechanism; accumulating the film in a short period of time with an amount corresponding to an amount discharged by a delivering and accumulating mechanism in a short period of time, simultaneously with the discharge of this film by the delivering and accumulating mechanism; and discharging the film accumulated by the winding and accumulating mechanism constantly at a specified rate until the next discharge time by the delivering and accumulating mechanism; and winding this film by a film winding mechanism.

Accumulation of the film by the delivering and accumulating mechanism is performed in such a manner that the film at a middle position between the first and second fixed rollers is wound around an outer periphery of an upstream-side movable roller from the first and second fixed rollers provided along a carrying route of the film, without allowing a friction to occur between the film and the outer periphery of the upstream-side movable roller, and the upstream-side movable roller is moved in such a way to pass through the middle position between the first and second fixed rollers and is moved away in a direction perpendicular to the carrying route of the film. The discharge of the film by the delivering and accumulating mechanism is performed in such a manner that the upstream-side movable roller around which the film is wound, is approached to the first and second fixed rollers without allowing the friction to occur between the film and the outer periphery of the upstream-side movable roller.

Further, the accumulation of the film by the winding and accumulating mechanism, is performed in such a manner that the film between the third and fourth fixed rollers is wound around the outer periphery of the downstream-side movable roller from the third and fourth fixed rollers provided along the carrying route of the film without allowing the friction to occur between the film and the outer periphery of the downstream-side movable roller, and the downstream-side movable roller is moved in such a way to pass through the middle position between the third and fourth fixed rollers and is moved away in the direction perpendicular to the carrying route of the film. Meanwhile, the discharge of the film by the winding and accumulating mechanism is performed in such a manner that the downstream-side movable roller around which the film is wound is approached to the third and fourth fixed rollers without allowing the friction to occur between the film and the outer periphery of the downstream-side movable roller.

Here, preferably, the discharged film is adsorbed on the outer periphery of either the second or the third fixed roller, or both of them during discharge of the film by the delivering and accumulating mechanism, and either the second or the third fixed roller, or both of them are rotated so that the speed on the outer periphery coincides with the discharging speed of the film. Then, when one of the second and the third fixed rollers is rotated with the film adsorbed thereon during discharge of the film by the delivering and accumulating mechanism, the friction is preferably not allowed to occur between the film wound around the outer periphery of the other one of the second and third fixed rollers, and the outer periphery of the other one of the second and the third fixed rollers.

Meanwhile, it is also acceptable to prevent the friction from generating between the film wound around the outer periphery of the second and the third fixed rollers, and the outer periphery of the second and third fixed rollers.

Further, preferably the wound film is floated from the outer periphery of the roller by air blown-out from the outer periphery of the roller respectively, to thereby not allow the friction to occur between the film and the outer periphery of the roller. Meanwhile, it is also acceptable to rotate the roller so that the speed on the outer periphery of the roller coincides with the carrying speed of the film wound around the outer periphery of the roller, to thereby not allow the friction to occur between the film and the roller.

According to the film intermittent carrying device and the film intermittent carrying method of the present invention, the accumulated film is discharged in a short period of time by the delivering and accumulating mechanism that accumulates a predetermined amount of film, and simultaneously the film with an amount corresponding to the amount discharged by the delivering and accumulating mechanism is accumulated by the winding and accumulating mechanism in a short period of time, thus carrying the film between the wind-off device and the winding device. Therefore, the rotation of the wind-off film roll in a relatively heavy wind-off device and the winding film roll in the winding device is not required to be suddenly accelerated or suddenly decelerated when the film is carried. Further, accumulation and discharge of the film is performed by moving away or approaching the movable roller from/to a pair of fixed rollers, to thereby accumulate and discharge the film. Therefore, in the movable roller, etc., around which the film is wound, the film wound around the movable roller, etc., is suddenly accelerated or suddenly decelerated. However, the friction is not allowed to occur between the wound film and the movable roller, and therefore the carrying speed of the film which is intermittently carried, can be remarkably increased while avoiding a state that scratches caused by the friction is generated on the film.

Other features which are considered as characteristic for the invention are set forth in the appended claims.

Although the invention is illustrated and described herein as embodied in a film intermittent carrying device and film intermittent carrying method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
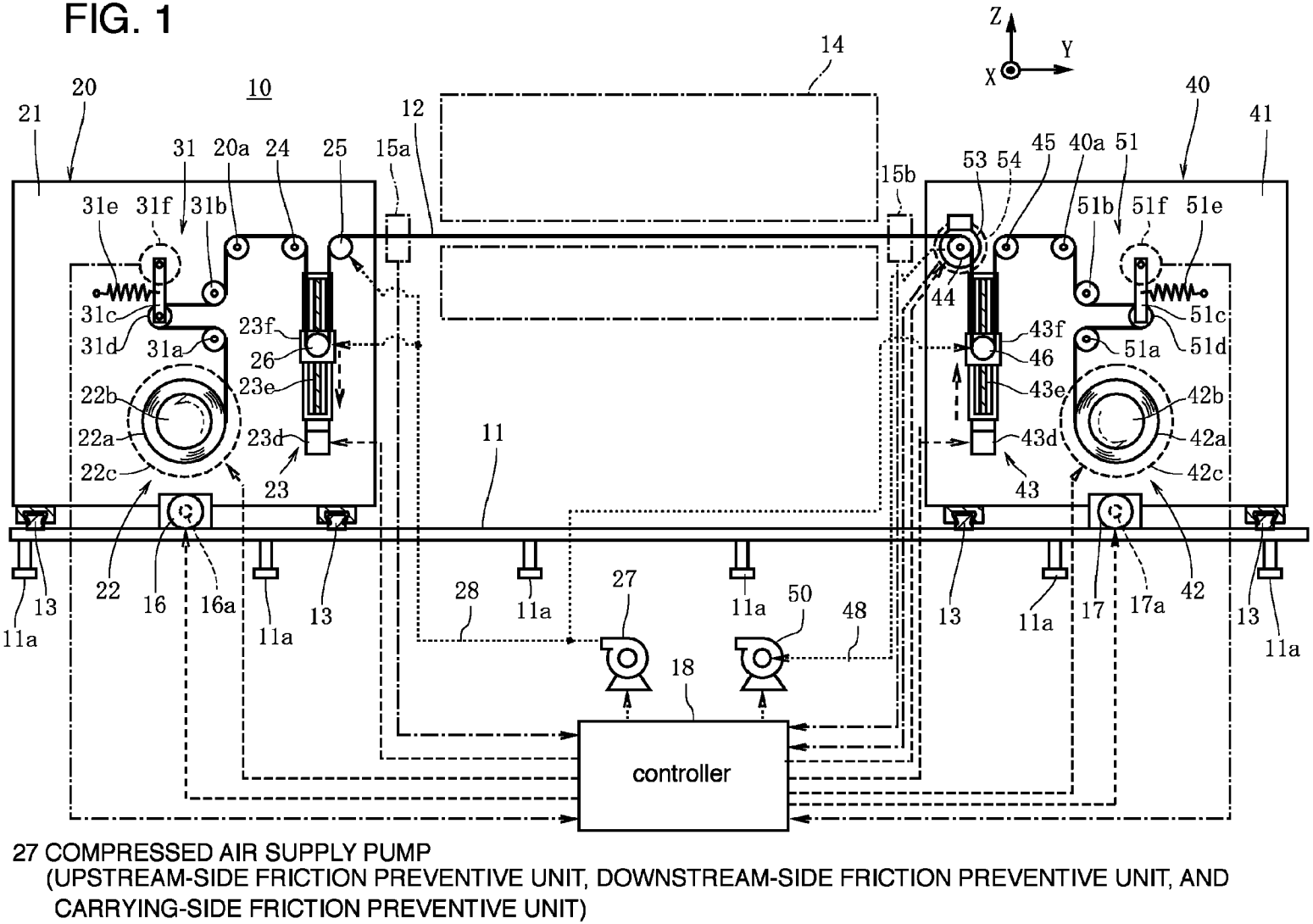
FIG. 1 is a front view showing a film intermittent carrying device according to an embodiment of the present invention.

Preferred embodiments of the present invention will be described next based on the drawing figures.

Referring now to the figures of the drawing in detail and first, particularly, to FIG. 1 thereof, there is shown a film intermittent carrying device 10 of the present invention. In FIG. 1, mutually perpendicular three axes of X, Y, Z are set, with X-axis extending approximately in a horizontal back and forth direction, Y-axis extending approximately in a horizontal direction, and Z-axis extending in a vertical direction, and explanation will be given for the intermittent carrying device 10 with this structure. The film intermittent carrying device 10 of the present invention includes a wind-off device 20 which is provided at one end side of a long and horizontal base 11 extending in a Y-axis direction and is configured to deliver a predetermined amount of film 12; a winding device 40 which is provided at the other end side of the base 11 and is positioned away from the wind-off device 20 in the Y-axis direction and is configured to wind a predetermined amount of film 12 delivered from the wind-off device 20; and a controller 18 configured to control them. The base 11 is horizontally installed through a plurality of attachment legs 11*a*, and a predetermined processor 14 such as a printer is provided between the wind-off device 20 and the winding device 40.

Guide rails 13 are provided at one end side and the other end side of the base 11 so as to extend in the X-axis direction, and through these guide rails 13, the wind-off device 20 and the winding device 40 are provided respectively movably in the X-axis direction. A wind-off positioning device 16 for moving and positioning the wind-off device 20 in the X-axis direction and inhibiting a movement of the positioned wind-off device 20, is provided in the wind-off device 20. Further, a winding positioning device 17 for moving and positioning the winding device 40 in the X-axis direction and inhibiting the movement of the positioned winding device 40, is provided in the winding device 40. Meanwhile, a wind-off edge sensor 15*a* for detecting a slippage of a film 12 delivered by the wind-off device 20 in the X-axis direction with respect to a processor 14, is provided between the wind-off device 20 and the processor 14. Further, a winding edge sensor 15*b* for detecting the slippage of the film 12 wound by the winding device 40 in the X-axis direction with respect to the winding device 40, is provided between the processor 14 and the winding device 40.

Detection outputs of the wind-off edge sensor 15*a* and the winding edge sensor 15*b*, are connected to a control input of the controller 18, and a control output from the controller 18 is connected to the wind-off positioning device 16 and the winding positioning device 17. Positioning devices 16, 17 in this embodiment are servo motors 16, 17 for rotating ball screws 16*a*, 17*a* extending in the X-axis direction and screwed into the wind-off device 20 and the winding device 40, thus fixing these servo motors 16 and 17 to the base 11. The controller 18 is configured to constantly confirm a position of the film 12 in the X-axis direction by the detection output of each edge sensor 15*a*, 15*b*, and constantly adjust positions of the wind-off device 20 and the winding device 40 in the X-axis direction, and control the positioning devices 16, 17 so that the position of the film 12 in the X-axis direction is always the same position.

Explanation will be given from the wind-off device 20. The wind-off device 20 includes a wind-off side perpendicular plate 21. Then, the wind-off device 20 includes a film delivery mechanism 22 for delivering the film 12 constantly at a specified rate, and a delivering and accumulating mechanism 23 for accumulating the film 12 delivered from the film delivery mechanism 22 and discharging it in a short period of time. The film delivery mechanism 22 includes a supplying reel 22*b* supported by the wind-off side perpendicular plate 21 pivotally, and a wind-off motor 22*c* provided on a rear side of the wind-off side perpendicular plate 21 for rotating the supplying reel 22*b*. The wind-off film roll 22*a* formed by taking-up the film 12, is attached to the supplying reel 22*b*, so that the wind-off film roll 22*a* is rotated together with the supplying reel 22*b* by the wind-off motor 22*c*. The wind-off motor 22*c* in this embodiment is the servo motor capable of changing a rotation speed of the supplying reel 22*b*, and the control output of the controller 18 is connected to the wind-off motor 22*c*. Then the film delivery mechanism 22 is configured to deliver the film 12 from the wind-off film roll 22*a* constantly at a specified rate, by rotating the supplying reel 22*b* by the wind-off motor 22*c* at a predetermined speed based on a command from the controller 18.

Further, the delivering and accumulating mechanism 23 in the wind-off device 20 includes first and second fixed rollers 24, 25 provided along the carrying route of the film 12; an upstream-side movable roller 26 moved in such a way to pass through a middle position between the first and second fixed rollers 24, 25 and moved in the direction perpendicular to the carrying route of the film 12; and a delivering and accumulating servo motor 23*d* for moving the upstream-side movable roller 26. According to this embodiment, a wind-off side deflecting roller 20*a* is provided on the wind-off side perpendicular plate 21 for deflecting the film 12 so that it is drawn from the wind-off film roll 22*a* and moves upward and is thereafter deflected horizontally, and the first and second fixed rollers 24, 25 are provided along the film 12 which is horizontally deflected by the wind-off side deflecting roller 20*a*. A ball screw 23*e* extending in a perpendicular direction is provided on the wind-off side perpendicular plate 21 so as to pass through a center of the first and second fixed rollers 24, 25, and a rotary shaft of the delivering and accumulating servo motor 23*d*, is connected to the ball screw so as to rotate the ball screw 23*e*. A wind-off side movable base 23*f* is screwed into the ball screw 23*e*, and the upstream-side movable roller 26 is provided on the wind-off side movable base 23*f*. Then, the control output of the controller 18 is connected to the delivering and accumulating servo motor 23*d*.

An upstream-side friction preventive unit 27 is provided in the delivering and accumulating mechanism 23, so as not to allow the friction to occur between the film 12 wound around the upstream-side movable roller 26, and the upstream-side movable roller 26. According to this embodiment, the control output of the controller 18 is connected to the friction preventive unit 27, and this friction preventive unit 27 is a compressed air supply pump 27 which is controlled by the controller 18. Then, the compressed air supply pump 27 functions to supply compressed air to the upstream-side movable roller 26, so that the film 12 wound around the upstream-side movable roller 26 is floated from the outer periphery of the upstream-side movable roller 26. Therefore, the upstream-side movable roller 26 is configured to float the film 12 wound around the outer periphery of the roller, by blowing-out the compressed air from its outer periphery, which is the compressed air supplied from the compressed air supply pump 27.

Figure 4:
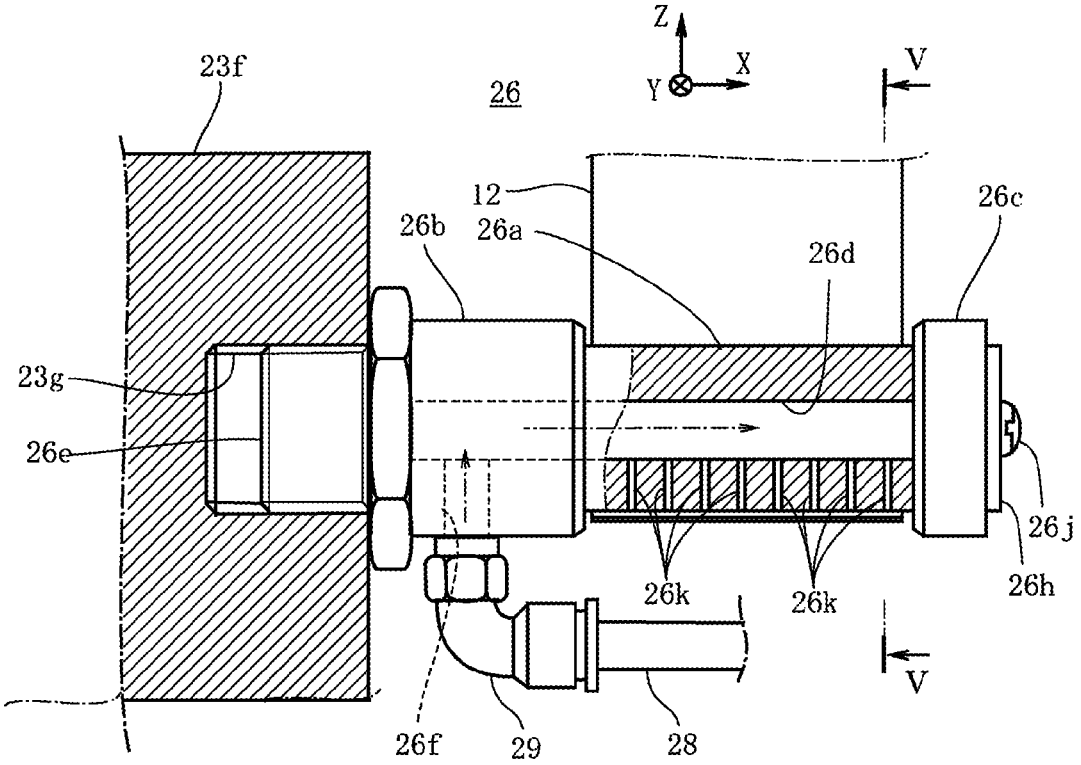
FIG. 4 is a cross-sectional block diagram of a movable roller.
Figure 5:
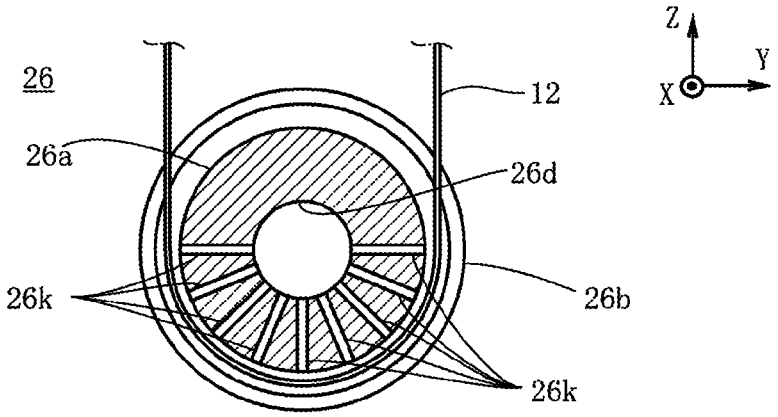
FIG. 5 is a cross-sectional view taken along the line V-V in FIG. 4.

FIG. 4 and FIG. 5 show a structure of the upstream-side movable roller 26 according to this embodiment. The upstream-side movable roller 26 includes a cylinder portion 26*a* configured to float the wound film 12 by the air blown-out from the outer periphery; wall members 26*b*, 26*c* provided at both sides of the cylinder portion 26*a* for limiting the movement of the film 12 in a width direction which is wound around the cylinder portion 26*a* and is floated. FIG. 4 and FIG. 5 show the upstream-side movable roller 26 in which the cylinder portion 26*a* and the wall members 26*b*, 26*c* are integrally formed by applying cutting process to a solid material made of metal or resin, etc., wherein the cylinder portion 26*a* is formed into a cylindrical shape with a through hole 26*d* formed along a central axis, and wall members 26*b*, 26*c* are provided so as to seal both ends in the axis direction.

The wall members 26*b*, 26*c* have larger outer diameters than the outer diameter of the cylinder portion 26*a*, and are provided at both sides of the cylinder portion 26*a* coaxially with the cylinder portion 26*a* with a space slightly wider than a width of the film 12. A male screw 26*e* coaxial with the cylinder portion 26*a* is formed on the wall member 26*b* at one end side of the cylinder portion 26*a*, and a female screw 23*g* into which the male screw 26*e* is fitted, is formed on the wind-off side movable base 23*f*. Then, the upstream-side movable roller 26 is fixed to the wind-off side movable base 23*f* by screwing the female screw 23*g* formed on the wind-off side movable base 23*f*, into the male screw 26*e*.

Further, a communication hole 26*f* communicated with the through hole 26*d* is formed in the wall member 26*b* at one end side so as to cross the central axis, and a first coupler 29 capable of fixing a first air tube 28 for supplying air, is provided at one end side of the communication hole 26*f*. In addition, a lid plate 26*h* is attached by a male screw 26*j* to the wall member 26*c* at the other end side of the cylinder portion 26*a* for sealing the other end side of the through hole 26*d* in the cylinder portion 26*a*. A plurality of air holes 26*k* with one end communicated with the through hole 26*d*, are formed in the cylinder portion 26*a* between the wall members 26*b*, 26*c*, radially from the central axis so that the other end is opened to an outer peripheral surface.

As shown in FIG. 5, the plurality of air holes 26*k* are formed at a portion where the film 12 is wound, and the compressed air supplied by the first air tube 28 from the compressed air supply pump 27 (FIG. 1) which is a friction preventive unit, is supplied into the through hole 26*d* through the first coupler 29 and the communication hole 26*f* shown in FIG. 4. Then, as shown by one dot chain arrow, the air passes through the through hole 26*d* and is blown out from the plurality of air holes 26*k* to an outer surface of the cylinder portion 26*a* of the upstream-side movable roller 26. Thus, the film 12 wound around the upstream-side movable roller 26 is floated by the air thus blown-out as shown in FIG. 5, so that the friction is not allowed to occur between the film 12 and the upstream-side movable roller 26. The wall members 26*b*, 26*c* provided at both sides of the cylinder portion 26*a* are positioned at both sides in a width direction of the film 12 which is wound around the cylinder portion 26*a* in a floated state, so that the film 12 is carried with its movement limited in the width direction.

In FIG. 1 again, in the delivering and accumulating mechanism 23 having the upstream-side movable roller 26, when the delivering and accumulating servo motor 23*d* is driven based on the command from the controller 18 to thereby rotate the ball screw 23*e*, the wind-off side movable base 23*f* screwed into the ball screw 23*e* is moved in the perpendicular direction, together with the upstream-side movable roller 26. The film 12 deflected by the wind-off side deflecting roller 20*a* and moved in the horizontal direction, is wound around an upper side of the first and second fixed rollers 24, 25. Meanwhile, the upstream-side movable roller 26 is positioned below the first and second fixed rollers 24, 25, and therefore the film 12 between the first and second fixed rollers 24, 25 is wound around the upstream-side movable roller 26 from below. Therefore, when the delivering and accumulating servo motor 23*d* is driven to make the upstream-side movable roller 26 descend, a perpendicular distance between the first and second fixed rollers 24, and the upstream-side movable roller 26 is expanded, and the film 12 having a length twice the perpendicular distance between the first and second fixed rollers 24, 25 and the upstream-side movable roller 26 is accumulated between the first and second fixed rollers 24, 25. Reversely, when the delivering and accumulating servo motor 23*d* is driven to elevate the upstream-side movable roller 26, the perpendicular distance between the first and second fixed rollers 24, 25 and the upstream-side movable roller 26 is narrowed, and the accumulated film 12 is discharged.

Here, the wind-off side deflecting roller 20*a* and the first fixed roller 24 are the self-rotation type rollers which are formed in such a manner that the film 12 is wound around the outer periphery of the wind-off side deflecting roller 20*a* and the first fixed roller 24 in a state of being brought into contact with these rollers, to thereby carry the wound film 12 while being deflected by rotation of these rollers themselves. In this point, the wind-off side deflecting roller 20*a* and the first fixed roller 24 are different from the upstream-side movable roller 26 which the film 12 is wound around in a state of being floated and is not rotated by itself.

Meanwhile, the second fixed roller 25 includes a carrying-side friction preventive unit which does not allow the friction to occur between the film 12 wound around the roller and the second fixed roller 25. The compressed air supply pump 27 serves as the carrying-side friction preventive unit for floating the film 12 wound around the second fixed roller 25 from the outer periphery of the second fixed roller 25 by supplying the compressed air to the second fixed roller 25, and the aforementioned compressed air supply pump 27 also serves as the friction preventive unit for floating the film 12 wound around the upstream-side movable roller 26 from the outer periphery of the upstream-side movable roller 26. As shown in FIG. 6A, the second fixed roller 25 is different from the upstream-side movable roller 26 which is configured to deflect the film by 180 degrees into a U-shape, in a point that the air holes 25*k* are formed in a range of 90 degrees from the center of the cylinder portion 25*a* around which the film 12 is wound and the film 12 is deflected in a direction of 90 degrees. However, the second fixed roller 25 has the same structure as the structure of the upstream-side movable roller 26 excluding a different point of the deflecting angle of the film 12, and therefore repeated explanation regarding this structure is omitted.

As shown in FIG. 1, the wind-off device 20 includes a tension adding device 31 for adding tension to the film 12 which is delivered from the film delivery mechanism 22 and is accumulated by the delivering and accumulating mechanism 23. The tension adding device 31 includes a pair of guide rollers 31*a*, 31*b* provided along the film 12 extending upward from the wind-off film roll 22*a* to the wind-off side deflecting roller 20*a*, and a dancer roller 31*d* provided between the pair of guide rollers 31*a*, 31*b* in such a manner as moving in the Y-axis direction by a lever 31*c*, and also includes a spring 31*e* for making the dancer roller 31*d* moved away from the pair of guide rollers 31*a*, 31*b*. The wind-off tension adding device 31 is configured to add a predetermined tension to the film 12 which is delivered from the film delivery mechanism 22, by an added force of the dancer roller 31*d* added by the spring 31*e*. The pair of guide rollers 31*a*, 31*b* and the dancer roller 31*d* are self-rotation type rollers formed in such a manner that the film 12 wound around the rollers is carried while being deflected by the rotation of these rollers themselves, with the film 12 wound around the pair of guide rollers 31*a*, 31*b* and the dancer roller 31*d* in a state of being brought into contact with the outer periphery of the rollers.

A position detecting angle sensor 31*f* for detecting a position of the dancer roller 31*d* from a sliding angle of the lever 31*c*, is provided on the other end of the lever 31*c* with the dancer roller 31*d* supported on one end, namely on a pivotally supporting point on the wind-off side perpendicular plate 21 of the lever 31*c*, so that the detection output of the angle sensor 31*f* is connected to the control input of the controller 18. The wind-off film roller 22*a* in the film delivery mechanism 22 delivers the film 12 by its rotation, and therefore when the film 12 is delivered, the outer diameter of the roll is gradually reduced, and an amount of the film 12 delivered per unit time is gradually reduced when the rotation speed is the same. When the amount of the delivered film 12 is reduced, the dancer roller 31*d* for adding tension to the film 12, is approached to the pair of guide rollers 31*a*, 31*b*. The movement of the dancer roller 31*d* is detected by the position detecting angle sensor 31*f*, and based on the detection output, the controller 18 is configured to control the wind-off motor 22*c*, change the rotation speed of the wind-off film roll 22*a* in accordance with a change of the outer diameter of the wind-off film roll 22*a*, and maintain a constant amount of the film 12 delivered per unit time.

Next, explanation will be given for the winding device 40 provided at the other end side of the base 11, which is positioned separately from the wind-off device 20. The winding device 40 is the device for winding a predetermined amount of film 12 which is delivered from the wind-off device 20 and has undergone the processing such as printing by the printer 14. The winding device 40 is formed symmetrically with the wind-off device 20, and includes a winding and accumulating mechanism 43 for accumulating the film 12 simultaneously with the discharge of the film 12, with an amount corresponding to an amount discharged by the delivering and accumulating mechanism 23 of the wind-off device 20 in a short period of time; and a film winding mechanism 42 for taking-up the film 12 discharged by the winding and accumulating mechanism 43 constantly at a specified rate.

The winding device 40 includes a winding-side perpendicular plate 41. The winding and accumulating mechanism 43 includes third and fourth fixed rollers 44, 45 provided along the carrying route of the film 12, a downstream-side movable roller 46 provided along the carrying route of the film 12 in such a way to pass through the middle position between the third and fourth fixed rollers 44, 45 and move in the direction perpendicular to the carrying route of the film 12, and a winding/accumulating servo motor 43*d* for moving the downstream-side movable roller 46. The winding and accumulating mechanism 43 is formed symmetrically with the delivering and accumulating mechanism 23, and similarly to the delivering and accumulating mechanism 23, the third and fourth fixed rollers 44, 45 are horizontally provided on the winding-side perpendicular plate 41, and a ball screw 43*e* extending in a perpendicular direction is provided on the winding-side perpendicular plate 41 so as to pass through the center of the third and fourth fixed rollers 44, 45. Then, the rotary shaft of the winding/accumulating servo motor 43*d* is connected to the ball screw 43*e* so that the ball screw 43*e* can be rotated. The winding-side movable base 43*f* is screwed into the ball screw 43*e*, and the downstream-side movable roller 46 is provided on the winding-side movable base 43*f*. Then, the control output of the controller 18 is connected to the winding/accumulating servo motor 43*d*.

The winding and accumulating mechanism 43 includes the downstream-side friction preventive unit 27 for not allowing the friction to occur between the film 12 wound around the downstream-side movable roller 46, and the downstream-side movable roller 46. According to this embodiment, the compressed air supply pump 27 for floating the film 12 wound around the downstream-side movable roller 46 from the outer periphery of the downstream-side movable roller 46 by supplying compressed air to the down-side movable roller 46 serves as the downstream-side friction preventive unit 27, and the aforementioned compressed air supply pump 27 for floating the film 12 wound around the upstream-side movable roller 26 from the outer periphery of the upstream-side movable roller 26 also serves as the friction preventive unit. Therefore, the downstream-side movable roller 46 is configured to blow-out the compressed air from the outer periphery, which is the compressed air supplied from the compressed air supply pump 27, so that the film 12 wound around the outer periphery can be floated. The downstream-side movable roller 46 used in this embodiment has the same structure as the structure of the upstream-side movable roller 26 shown in FIG. 4 and FIG. 5, and the downstream-side movable roller 46 having the same structure is provided on the winding-side movable base 43*f* in the winding and accumulating mechanism 43. Therefore, repeated explanation for a specific structure of the downstream-side movable roller 46 is omitted.

In the winding and accumulating mechanism 43 having the downstream-side movable roller 46 as described above, when the winding/accumulating servo motor 43*d* is driven based on the command from the controller 18, the winding-side movable base 43*f* screwed into the ball screw 43*e* is moved in a perpendicular direction together with the downstream-side movable roller 46. Predetermined processing is applied to the film 12 delivered from the wind-off device 20 by the processor 14 such as a printer, and thereafter the film 12 that has undergone the processing is wound around the upper side of the third and fourth fixed rollers 44, 45 in a horizontal state. Then, the film 12 between the third and fourth fixed rollers 44, 45 is wound from below, around the downstream-side movable roller 46 which is positioned below the third and fourth fixed rollers 44, 45. Therefore, when the winding/accumulating servo motor 43*d* is driven to descend the downstream-side movable roller 46, a perpendicular distance between the third and fourth fixed rollers 44, 45 and the downstream-side movable roller 46 is expanded, and the film 12 with a length twice the perpendicular distance between the third and fourth fixed rollers 44, 45 and the downstream-side movable roller 46, is accumulated between the third and fourth fixed rollers 44, 45. Meanwhile, when the winding/accumulating servo motor 43*d* is driven to elevate the downstream-side movable roller 46, the perpendicular distance between the third and fourth fixed rollers 44, 45 and the downstream-side movable roller 46 is narrowed, to thereby discharge the accumulated film 12.

Further, the film winding mechanism 42 functions to wind the film 12 discharged by the winding and accumulating mechanism 43 constantly at a specified rate, and includes a winding reel 42*b* for taking-up the film 12 discharged by the winding and accumulating mechanism 43. The winding reel 42*b* is supported pivotally by the winding-side perpendicular plate 41, and a winding motor 42*c* for rotating the winding reel 42*b* is provided on a rear side of the winding-side perpendicular plate 41. The winding motor 42*c* in this embodiment is the servo motor capable of changing the rotation speed of the winding reel 42*b*, and the control output of the controller 18 is connected to the winding motor 42*c*. Then, the film winding mechanism 42 is configured to wind the film 12 gradually discharged by the winding and accumulating mechanism 43 constantly at a specified rate by rotating the winding reel 42*b* by the winding motor 42*c* at a predetermined speed based on the command from the controller 18.

Here, the self-rotation type rollers are used as the deflecting roller 40*a* and the fourth fixed roller 45, which are formed in such a manner that the film 12 wound around the outer periphery of the rollers is carried while being deflected by the rotation of these rollers themselves, with the film 12 wound around the outer periphery of the rollers in a state of being brought into contact with the outer periphery. In this point, the winding-side deflecting roller 40*a* and the fourth fixed roller 45 are different from the downstream-side movable roller 46 which the film 12 is wound around in a state of being floated and is not rotated by itself.

Figure 6:
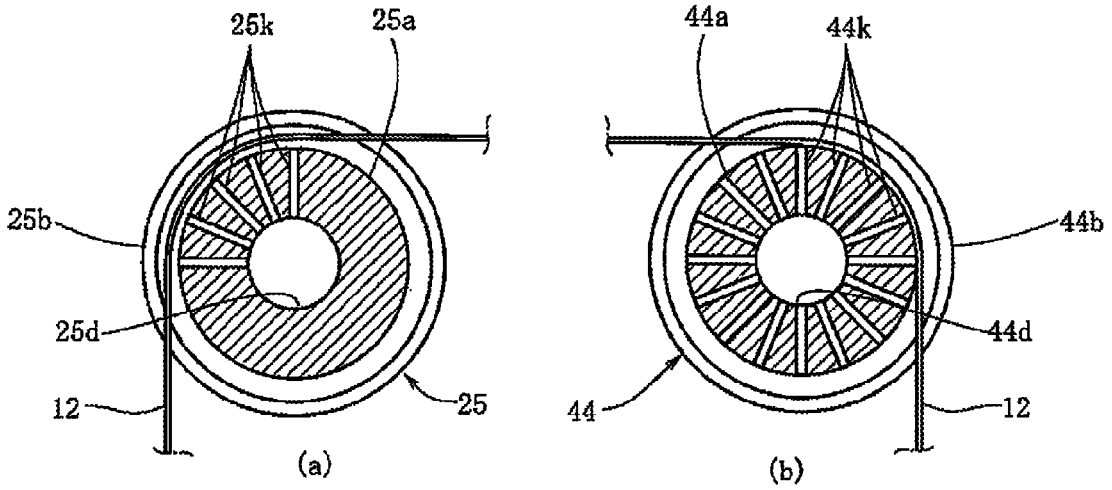
FIG. 6 is a cross-sectional view of a second fixed roller and a third fixed roller corresponding to FIG. 5.
Figure 7:
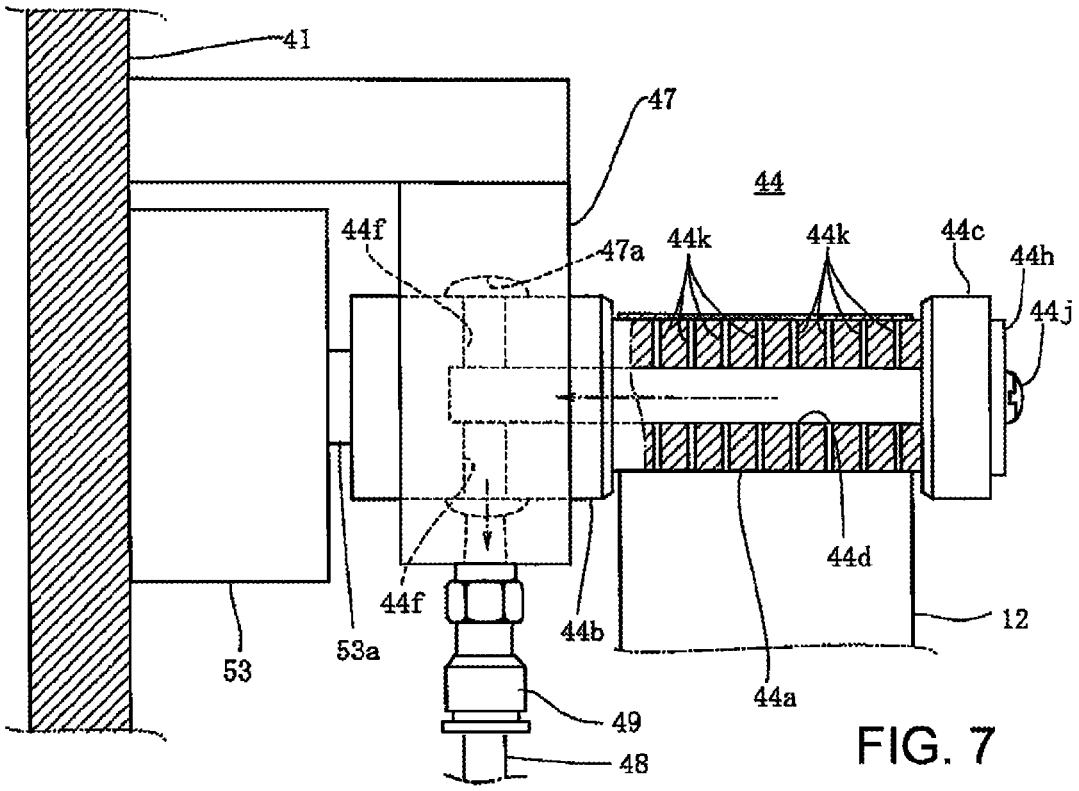
FIG. 7 is a cross-sectional block diagram of a fourth fixed roller.

Meanwhile, the third fixed roller 44 is configured to be rotatable in with the film 12 adsorbed thereon, which is the film wound around this roller. FIG. 6(*b*) and FIG. 7 show the structure of the third fixed roller 44 according to this embodiment. The third fixed roller 44 has a cylinder portion 44*a* capable of adsorbing the film 12 wound around the roller, on its outer periphery by the air sucked from the outer periphery; and has wall members 44*b*, 44*c* provided at both sides of the cylinder portion 44*a* for limiting the movement of the film 12 in the width direction, which is the film wound and adsorbed on the cylinder portion 44*a*. FIG. 6(*b*) and FIG. 7 show the third fixed roller 44 in which the cylinder portion 44*a* and the wall members 44*b*, 44*c* are integrally formed by applying cutting process to a solid material made of metal or resin, etc., wherein the cylinder portion 44*a* is formed into a cylindrical shape with a through hole 44*d* formed along a central axis, and wall members 44*b*, 44*c* are provided so as to seal both ends in the axis direction.

As shown in FIG. 7, the wall members 44*b*, 44*c* have larger outer diameters than the outer diameter of the cylinder portion 44*a*, and are provided at both sides of the cylinder portion 44*a* coaxially with the cylinder portion 44*a* with a space slightly wider than the width of the film 12. A communication hole 44*f* communicated with the through hole 44*d* is formed on the wall member 44*b* at one end side so as cross the central axis. Further, a lid plate 44*h* for sealing the other end side of the through hole 44*d* in the cylinder portion 44*a* is attached to the wall member 44*c* at the other end side of the cylinder portion 44*a* by a male screw 44*j*. A plurality of air holes 44*k* with one end communicated with the through hole 44*d*, are radially formed in the cylinder portion 44*a* between the wall members 44*b*, 44*c* so that the other end is opened to the outer peripheral surface.

The third fixed roller 44 with this structure is coaxially attached to a rotary shaft 53*a* of a winding servo motor 53, and the winding servo motor 53 is attached to the winding-side perpendicular plate 41. Then, an encircling member 47 for encircling the wall member 44*b* at one end side is attached to the winding-side perpendicular plate 41. A peripheral groove 47*a* facing the communication hole 44*f* formed on the wall member 44*b* at one end side, is formed on an inner periphery of the encircling member 47, and a second coupler 49 capable of fixing a second air tube 48 communicated with the peripheral groove 47*a* for sucking the air, is provided in the encircling member 47.

The second air tube 48 is connected to an air suction pump 50 (FIG. 1), and when the air inside of the through hole 44*d* is sucked through the second air tube 48, the second coupler 49, and the communication hole 44*f* as shown by one dot chain arrow of FIG. 7, and when the air around the cylinder portion 44*a* of the third fixed roller 44 is sucked from the plurality of air holes 44*k* into the through hole 44*d*, the film 12 wound around the third fixed roller 44 is adsorbed on the outer peripheral surface as shown in FIG. 6(*b*) and FIG. 7 by the sucked air. Then, the wall members 44*b*, 44*c* provided at both sides of the cylinder portion 44*a* are positioned at both sides in the width direction of the film 12 which is wound and adsorbed on the cylinder portion 44*a*, so that the film 12 is adsorbed on the periphery of the cylinder portion 44*a* in a state of limiting the movement of the film 12 in the width direction.

In FIG. 1 again, the control output from the controller 18 is connected to the winding servo motor 53 with the third fixed roller 44 with this structure coaxially attached to the rotary shaft 53*a* (FIG. 7), and when the winding servo motor 53 is driven based on the command from the controller 18, the third fixed roller 44 is rotated and the film 12 adsorbed on the outer periphery of the third fixed roller 44 is taken-up toward the winding and accumulating mechanism 43. Then, when the rotation of the third fixed roller 44 by the winding servo motor 53 is stopped, take-up of the film 12 is also stopped. Further, a film rate detecting encoder 54 is coaxially provided in the winding servo motor 53, so that number of rotations of the third fixed roller 44 is detected by this encoder 54. Then, the detection output of the film rate detecting encoder 54 is connected to the control input of the controller 18, and the controller 18 is configured to calculate a take-up amount of the film 12 from the number of rotations of the third fixed roller 44 and its diameter.

Further, the winding device 40 is provided with a winding tension adding device 51 for adding predetermined tension to the film 12 discharged by the winding and accumulating mechanism 43 and wound by the film winding mechanism 42. The tension adding device 51 includes a pair of guide rollers 51*a*, 51*b* provided along the film 12 extending downward from the winding and accumulating mechanism 43 through the winding-side deflecting roller 40*a*, and a dancer roller 51*d* provided between the pair of guide rollers 51*a*, 51*b* and capable of moving in the Y-axis direction by the lever 51*c*, and further includes a spring 51*e* for making the dancer roller 51*d* move away from the pair of guide rollers 51*a*, 51*b*. The winding tension adding device 51 is configured to add a predetermined tension to the film 12 discharged by the winding and accumulating mechanism 43 and wound by the film winding mechanism 42, by the added force of the dancer roller 51*d* added by the spring 51*e*. The pair of guide rollers 51*a*, 51*b* and the dancer roller 51*d* are the self-rotation type rollers which are formed in such a manner that the film 12 wound around the rollers is carried while being deflected by the rotation of these rollers themselves, with the film 12 wound around the outer periphery in a state of being brought into contact with the outer periphery.

A position detecting angle sensor 51*f* for detecting a position of the dancer roller 51*d* from a sliding angle of the lever 51*c*, is provided on the other end of the lever 51*c* with the dancer roller 51*d* supported on one end, namely on a pivotally supporting point on the wind-off side perpendicular plate 41 of the lever 51*c*, and the detection output of the angle sensor 51*f* is connected to the control input of the controller 18. The winding film roll 42*a* formed of the film 12 wound by the film winding mechanism 42, takes-up the film 12 by rotation of itself, and therefore the outer diameter of the winding film roll 42*a* is gradually increased with a progress of taking-up the film 12, and in a case of the same rotation speed of the winding film roll 42*a*, the winding rate of the film 12 taken-up per unit time is gradually increased. When the winding rate of the film 12 is increased, the dancer roller 51*d* for adding tension to the film 12, is approached to the pair of guide rollers 51*a*, 51*b*. The movement of the dancer roller 51*d* is detected by the position detecting angle sensor 51*f*, and based on this detection output, the controller 18 is configured to control the winding motor 42*c* and change the rotation speed of the winding reel 42*b* in accordance with the change of the outer diameter of the winding film roll 42*a*, and maintain the winding rate of the film 12 taken-up per unit time constantly at a specified rate.

A film intermittent carrying method of the present invention will be described next.

The film intermittent carrying method of the present invention for carrying the film 12 includes: repeating by means of the delivering and accumulating mechanism 23 a process of gradually accumulating the film 12 delivered by the film delivery mechanism 22 constantly at a specified rate, and discharging this film in a short period of time; delivering the film 12 in an amount of the film discharged in a short period of time by the delivering and accumulating mechanism 23, and simultaneously with the discharging of the film by the winding and accumulating mechanism 23, accumulating the film by the winding and accumulating mechanism 43 in a short period of time; discharging the film 12 accumulated by the winding and accumulating mechanism 43 constantly at a specified rate until the next discharge time by the delivering and accumulating mechanism 23; and winding this film 12 by the film winding mechanism 42. Thus, the film 12 between the wind-off device 20 and the winding device 40 is repeatedly carried and rested, and as a result, the film 12 is intermittently carried. FIG. 1 shows a state that carrying of the film 12 between the wind-off device 20 and the winding device 40 is stopped, and in the middle of the stop of carrying the film 12, the film 12 delivered by the film delivery mechanism 22 constantly at a specified rate, is gradually accumulated by the delivering and accumulating mechanism 23, and the film 12 discharged by the winding and accumulating mechanism 43 constantly at a specified rate, is wound by the film winding mechanism 42. Each operation of them will be described hereafter in detail, wherein the operation shown below is controlled by the controller 18.

When the film 12 between the wind-off device 20 and the winding device 40 is rested, the air suction pump 50 is driven to adsorb the film 12 wound around the third fixed roller 44 on the outer peripheral surface, and the rotation of the third fixed roller 44 by the winding servo motor 53 is stopped. Then, both the delivery of the film 12 by the wind-off device 20 and take-up of the film 12 by the winding device 40 are stopped, and the film 12 between the wind-off device 20 and the winding device 40 can be rested. Then, the rested film 12 can be processed by the processor 14 of the film 12 such as a printer provided between the wind-off device 20 and the winding device 40.

During rest of the film 12 between the wind-off device 20 and the winding device 40, the wind-off device 20 delivers the film 12 to be delivered at the next carrying time by the film delivery mechanism 22 constantly at a specified rate, and also delivers the film 12 thus delivered constantly at a specified rate and accumulates the film 12 by the delivering and accumulating mechanism 23. Delivery of the film 12 is performed by rotating the supplying reel 22*b* by the wind-off motor 22*c* at a constant speed based on the command from the controller 18, so that the film 12 is delivered constantly at a specified rate by rotation of the wind-off film roll 22*a* supported by the supplying reel 22*b* as shown by broken arrow of FIG. 1. Then, the accumulation of the film 12 by the delivering and accumulating mechanism 23 is performed by gradually making the upstream-side movable roller 26 move away from the first and second fixed rollers 24, 25 as shown by broken arrow of FIG. 1, which is the upstream-side movable roller 26 around which the film 12 is wound at the middle position between the first and second fixed rollers 24, 25 from the first and second fixed rollers 24, 25 provided along the carrying route of the film 12, and movable in a direction perpendicular to the carrying route of the film 12.

At this time, the compressed air supply pump 27 is driven to supply the compressed air to the upstream-side movable roller 26, and the film 12 wound around the upstream-side movable roller 26 is floated from the outer periphery of the upstream-side movable roller 26. Then, the perpendicular distance between the first and second fixed rollers 24, 25 and the upstream-side movable roller 26 is expanded, and the film 12 with a length twice the perpendicular distance between the first and second fixed rollers 24, 25 and the upstream-side movable roller 26, is accumulated between the first and second fixed rollers 24, 25. Simultaneously, as shown by broken arrow in FIG. 1, in the winding device 40, the downstream-side movable roller 46 is gradually approached to the third and fourth fixed rollers 44, 45. This point will be described later.

Figure 2:
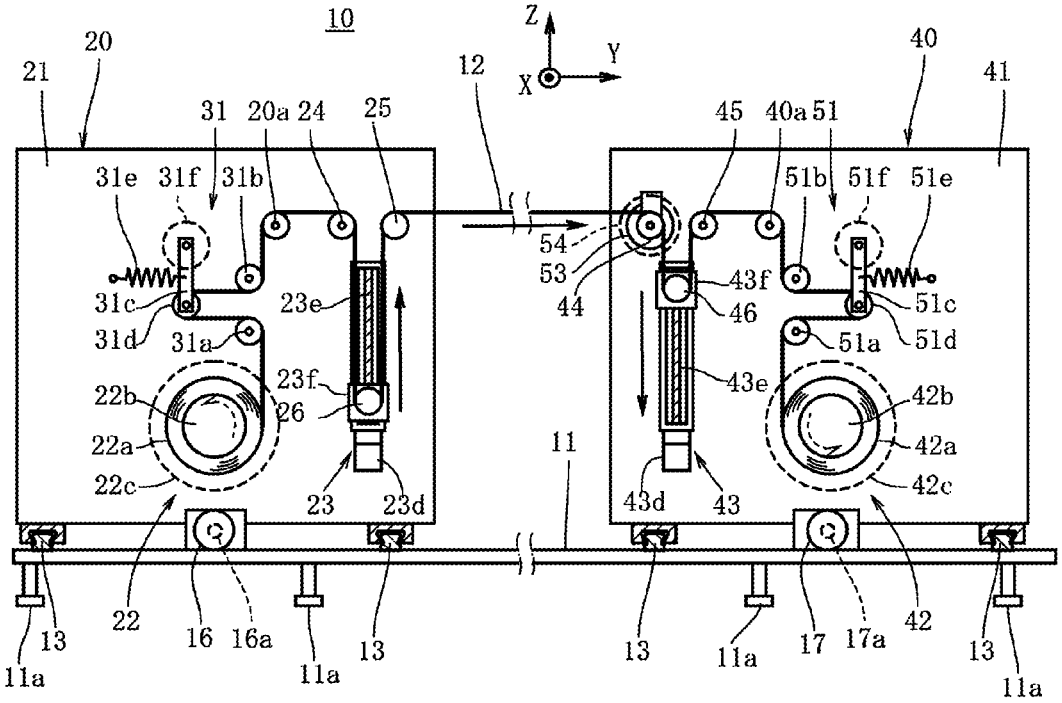
FIG. 2 is a front view showing a state immediately before the film is carried between a wind-off device and a winding device of the intermittent carrying device.

FIG. 2 shows a state that a predetermined amount of film 12 is accumulated by the delivering and accumulating mechanism 23. Thereafter, the film 12 is carried. Specifically, the delivering and accumulating mechanism 23 shown in FIG. 2 accumulating the predetermined amount of film 12, discharges the accumulated film 12 thereafter in a short period of time. Simultaneously with the discharge of the film 12 by the delivering and accumulating mechanism 23, the film 12 with an amount corresponding to the discharged amount is accumulated in a short period of time by the winding and accumulating mechanism 43. The air suction pump 50 is driven to carry the film 12 so that the film 12 wound around the third fixed roller 44 is adsorbed on the outer peripheral surface, and the winding servo motor 53 in the winding device 40 is also driven to rotate the third fixed roller 44. Thus, the film 12 can be carried between the wind-off device 20 and the winding device 40.

A carrying amount of the film 12 is previously determined by the controller 18, and the carrying amount is adjusted by the number of rotations of the third fixed roller 44 in the winding device 40. That is, under control of the controller 18, a value is obtained by dividing the previously defined carrying amount by the outer periphery of the third fixed roller 44, and based on this value, the third fixed roller 44 is rotated in a short period of time. Thus, the predetermined amount of the film 12 is carried in a short period of time, and the number of rotations of the third fixed roller 44 is detected by the film rate detecting encoder 54 provided therein and is fed-back to the controller 18. Then, when the film 12 is carried the processing of the film 12 by the processor 14 such as a printer provided between the wind-off device 20 and the winding device 40, is stopped once.

When the film 12 is carried, the delivering and accumulating mechanism 23 discharges the film 12 accumulated therein in a short period of time. The discharge of the film 12 is performed in such a manner that the upstream-side movable roller 26 is suddenly approached to the first and second fixed rollers 24, 25 in a short period of time by the delivering and accumulating servo motor 23*d* as shown by solid arrow of FIG. 2. That is, the upstream-side movable roller 26 with a length half of the film 12 carried by rotating the third fixed roller 44, is approached to the first and second fixed rollers 24, 25. Such an approach of the upstream-side movable roller 26 is performed in synchronization with the rotation of the third fixed roller 44, in such a way that the upstream-side movable roller 26 is approached thereto in a short period of time of carrying the film 12 by rotating the third fixed roller 44. Then, in a state that the film 12 between the first and second fixed rollers 24, 25 is wound around the upstream-side movable roller 26 in a U-shape, the film 12 with a length corresponding to a sum of a length equal to twice the moving amount of the upstream-side movable roller 26, and the film 12 delivered from the film delivery mechanism 22 in such a short period of time, is delivered from the delivering and accumulating mechanism 23 in a short period of time.

In the delivering and accumulating mechanism 23, the compressed air supply pump 27 is driven when the film 12 is delivered, to thereby supply the compressed air to the second fixed roller 25 and the upstream-side movable roller 26, and the film 12 wound around the second fixed roller 25 and the upstream-side movable roller 26 is floated from the outer periphery of the second fixed roller 25 and the upstream-side movable roller 26 respectively. That is, when the film 12 is brought into contact with the outer peripheral surface of the second fixed roller 25 and the upstream-side movable roller 26, these rollers 25, 26 are rotated when the film 12 is carried. However, when the film 12 is delivered at a relatively fast accelerated speed by the inertia force of the rollers 25, 26, the film 12 which is brought into contact with the outer surface of the rollers 25, 26, and the outer surface of the rollers are rubbing each other. Then, it appears that the friction occurs between the film 12 and the outer surface of these rollers. However, by floating the film 12 from the outer periphery of the second fixed roller 25 and the upstream-side movable roller 26, the friction between the film 12 and the outer surface of the rollers 25, 26 is prevented, and therefore scratches, etc., caused by the friction, is prevented from generating on the film 12.

Meanwhile, the wind-off side deflecting roller 20*a* and the first fixed roller 24 are the self-rotation type rollers which are formed in such a manner that the film wound around the rollers is carried while being deflected by the rotation of the these rollers themselves, with the film 12 wound around the outer periphery in a state of being brought into contact with the outer periphery. Further, the pair of guide rollers 31*a*, 31*b* and the dancer roller 31*d* are also the self-rotation type rollers which are formed in such a manner that the film 12 wound around the rollers is carried while being deflected by the rotation of these rollers themselves, with the film 12 wound around the outer periphery in a state of being brought into contact with the outer periphery. However, since the film 12 is delivered from the film delivery mechanism 22 constantly at a specified rate, the film 12 wound around the rollers 20*a*, 24, 31*a*, 31*b*, 31*d* is moved constantly at a specified rate. Therefore, the rollers 20*a*, 24, 31*a*, 31*b*, 31*d* are rotated constantly at a specified rate, and the rotation speed of them is neither suddenly accelerated nor suddenly decelerated. Therefore, the friction does not occur between the film 12 and these rollers, which is the friction caused by rubbing of the film 12 against the outer surface of these rollers 20*a*, 24, 31*a*, 31*b*, 31*d*. Therefore, the scratches caused by the friction are not generated on the film 12, and in the wind-off device 20 with this structure, the film 12 can be delivered without generating the scratches on the film 12.

Meanwhile, in the winding and accumulating mechanism 43, simultaneously with the discharge of the film 12 by the delivering and accumulating mechanism 23, the film 12 with an amount corresponding to an amount discharged by the delivering and accumulating mechanism 23, is accumulated in a short period of time. The accumulation is performed in such a manner that by means of the accumulating servo motor 43*d* the downstream-side movable roller 46 is suddenly moved away from the third and fourth fixed rollers 44, 45 in a short period of time as shown by solid arrow of FIG. 2. That is, the film 12 that has undergone predetermined processing such as printing by the processor 14, is taken-up by rotating the third fixed roller 44 using the winding servo motor 53, and the downstream-side movable roller 46 with a length corresponding to the length half of the taken-up film 12, is moved away from the third and fourth fixed rollers 44, 45. The downstream-side movable roller 46 is thus moved away in synchronization with the rotation of the third fixed roller 44, and the downstream-side movable roller 46 is moved away in a short period of time of carrying the film 12 by rotating the third fixed roller 44. Then, in a state that the film 12 between the third and fourth fixed rollers 44, 45 is wound around the downstream-side movable roller 46 in the U-shape, the film 12 with a length corresponding to the sum of a length equal to twice the moving amount of the downstream-side movable roller 46 and the film 12 taken-up by the film winding mechanism 42, is taken-up in a short period of time, and is accumulated between the third and fourth fixed rollers 44, 45.

In the winding and accumulating mechanism 43 as well, the compressed air supply pump 27 is driven when the film 12 is taken-up, to thereby supply the compressed air to the downstream-side movable roller 46, and the film 12 wound around the downstream-side movable roller 46 is floated from the outer periphery of the downstream-side movable roller 46. That is, when the film 12 is brought into contact with the outer peripheral surface of the downstream-side movable roller 46, the roller 46 is rotated when the film 12 is carried, and when the film 12 is accumulated at a relatively fast accelerated speed by the inertia force of the roller 46, the film 12 in contact with the outer surface of the roller 46, rubs against the outer surface, and it appears that the friction occurs between them. However, by floating the film 12 from the outer periphery of the downstream-side movable roller 46, the friction between the film 12 and the outer surface of the roller 46 is prevented, and the scratches, etc., in the film 12 caused by the friction can be prevented.

Then, the winding and accumulating mechanism 43 simultaneously accumulates the film 12 with an amount corresponding to the amount discharged by the delivering and accumulating mechanism 23 in a short period of time. Therefore according to this embodiment wherein the winding and accumulating mechanism 43 is used, which has the same structure as the structure of the delivering and accumulating mechanism 23, the moving amount of the upstream-side movable roller 26 in the delivering and accumulating mechanism 23, and the moving amount of the downstream-side movable roller 46 in the winding and accumulating mechanism 43 are same. Then, the film 12 with an amount about twice the moving amount of the upstream-side movable roller 26 and the downstream-side movable roller 46, is delivered and taken-up. Therefore, the film 12 can be actually carried at a speed twice the speed of moving each movable roller 26, 46, by moving these rollers at a relatively high speed by each of the accumulating servo motors 23*d*, 43*d*.

Figure 3:
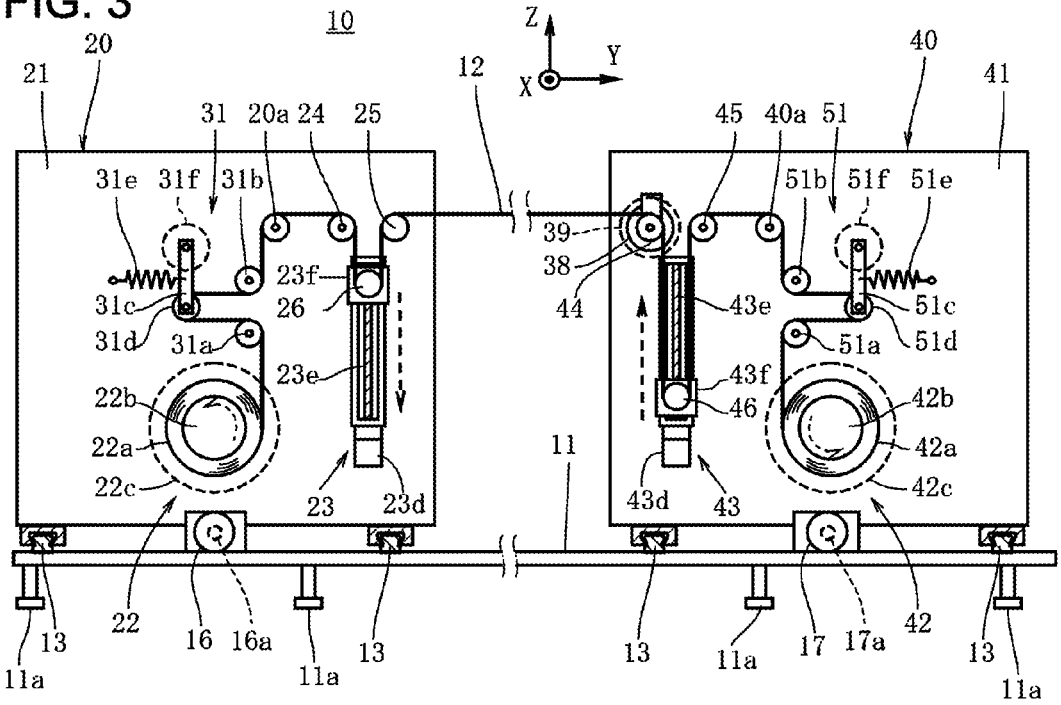
FIG. 3 is a front view showing a state immediately after the film is carried between the wind-off device and the winding device of the intermittent carrying device.

FIG. 3 shows a state immediately after the predetermined amount of film 12 is carried between the wind-off device 20 and the winding device 40. Thus, immediately after the predetermined amount of film 12 is carried, the delivery of the film 12 by the wind-off device 20 is inhibited, and the rotation of the third fixed roller 44 with the film 12 adsorbed on the outer peripheral surface is stopped, which is the rotation driven by the winding servo motor 53, to thereby further stop the take-up of the film 12 by the winding device 40. Thus, the film 12 between the wind-off device 20 and the winding device 40 is set in a rest state again. Then, processing is applied to the rested film 12 again by the processor 14 such as a printer provided between the wind-off device 20 and the winding device 40. In the wind-off device 20, while the film 12 is rested, as described above, the film 12 to be delivered in the next carrying time is delivered by the film delivery mechanism 22 constantly at a specified rate, and the upstream-side movable roller 26 is gradually moved away from the first and second fixed rollers 24, 25, to thereby gradually accumulate the film 12 thus delivered constantly at a specified rate, by the delivering and accumulating mechanism 23 as shown by broken arrow of FIG. 3.

Meanwhile, in the winding device 40, the film 12 accumulated by the winding and accumulating mechanism 43 during previous carrying of the film 12, is gradually discharged while the film 12 is rested between the wind-off device 20 and the winding device 40, and the discharged film 12 is taken-up by the film winding mechanism 42 constantly at a specified rate. The discharge of the film 12 by the winding and accumulating mechanism 43, is performed in such a manner that the film 12 is wound around the roller, and the downstream-side movable roller 46 with the film 12 accumulated between the third and fourth fixed rollers 44, 45, is gradually approached to the third and fourth fixed rollers 44, 45 as shown by broken arrow of FIG. 3. At this time, the compressed air supply pump 27 is driven to supply the compressed air to the downstream-side movable roller 46, and the film 12 wound around the downstream-side movable roller 46 is floated from the outer periphery of the downstream-side movable roller 46. The downstream-side movable roller 46 is moved by driving the winding/accumulating servo motor 43*d*. Then, when the perpendicular distance between the third and fourth fixed rollers 44, 45, and the downstream-side movable roller 46 is reduced, the film 12 with a length twice the reduced perpendicular distance between the third and fourth fixed rollers 44, 45, and the downstream-side movable roller 46, is gradually discharged. The discharge of the film 12 by the winding and accumulating mechanism 43 is completed by the next time of carrying the film 12.

Take-up of the film 12 by the film winding mechanism 42 is performed by rotating the winding reel 42*b* by the winding motor 42*c* based on the command from the controller 18. Thus, the film 12 discharged from the winding and accumulating mechanism 43 is taken-up by the winding reel 42*b* constantly at a specified rate.

Here, the self-rotation type rollers are used as the winding-side deflecting roller 40*a* and the fourth fixed roller 45, which are formed in such a manner that the film 12 wound around the rollers is carried while being deflected by the rotation of these rollers themselves, with the film 12 wound around the outer periphery in a state of being brought into contact with the outer periphery. Further, the pair of guide rollers 51*a*, 51*b* and the dancer roller 51*d* are also the self-rotation type rollers formed in such a manner that the film 12 wound around the rollers is carried while being deflected by the rotation of these rollers themselves, with the film 12 wound around the outer periphery in a state of being brought into contact with the outer periphery. However, the film winding mechanism 42 functions to take-up the film 12 constantly at a specified rate, and therefore the film 12 wound around the rollers 40*a*, 45, 51*a*, 51*b*, 51*d* is moved constantly at a specified rate. Therefore, the rollers 40*a*, 45, 51*a*, 51*b*, 51*d* are always rotated at a constant speed, and the rotation speed is not suddenly accelerated or suddenly decelerated. Therefore, the scratches, etc., are not generated on the film 12, which are the scratches caused by the friction by the rubbing of the film 12 against the outer surfaces of the rollers 40*a*, 45, 51*a*, 51*b*, 51*d*, and the film 12 can be taken-up by the winding device 40 without generating the scratches on the film 12.

Further, when the film 12 is carried, the film 12 is adsorbed on the outer peripheral surface of the third fixed roller 44 around which the film 12 is wound, and the third fixed roller 44 itself is forcibly rotated by the winding servo motor 53. Therefore, the friction is not generated between the film 12 and the outer surface of the third fixed roller 44, which is caused by rubbing of the film 12 against the outer surface of this roller. Therefore, the scratches, etc., caused by the friction, is not generated on the film 12, and therefore the film intermittent carrying device 10 is capable of carrying the film 12 without generating the scratches, etc., on the film 12.

By repeating carrying and rest of the film 12 as described above, the film 12 is intermittently carried. Then, according to the present invention, accumulation and discharge of the film 12 is performed by moving away or approaching the movable rollers 26, 46 from/to the first and second fixed rollers 24, 25, 44, 45 in each accumulation mechanism 23, 43, and each of the movable rollers 26, 46 is moved away or approached without generating the friction between the outer periphery of each movable roller 26, 46, and the film 12. Therefore, generation of the scratches caused by rubbing of the film 12 against each movable roller 26, 46, can be prevented. Accordingly, with the movable rollers being moved at relatively high speed, the carrying speed of the film 12 can be remarkably increased, without generating the scratches on the film 12 which is intermittently carried.

Further, in the wind-off device 20, the film 12 is delivered from the wind-off film roll 22*a* constantly at a specified rate, and the supplying reel 22*b* in the film delivery mechanism 22 can be continuously rotated in a period from the rest of the film 12 until the film 12 is carried again, by making the amount of the film 12 delivered by the film delivery mechanism 22 coincide with the amount of the carried film 12. Further, in the winding device 40, the film 12 is gradually discharged from the accumulation mechanism 43, and the film 12 is taken-up by the winding reel 42*b* constantly at a specified rate. Therefore, the winding reel 42*b* can be continuously rotated by making the amount of the taken-up film 12, coincide with the amount of the film 12 carried in a period from the stop of the film 12 until the film 12 is carried. Further, according to the present invention, the rotation of each film roll 22*a*, 42*a* is neither suddenly accelerated nor suddenly decelerated. Therefore, in the winding motor 22*c* and the winding motor 42*c* for rotating each of the film rolls 22*a*, 42*a*, a motor having an output capable of rotating the supplying reel 22*b* and the winding reel 42*b* at a constant speed, can be used. Therefore, the motor with large output compared with a conventional motor, is not required to be provided. Therefore, increase in a size of the intermittent carrying device 10 can be prevented, and a relatively inexpensive intermittent carrying device 10 can be obtained.

Meanwhile, the wind-off film roll 22*a* in the film delivery mechanism 22 delivers the film 12 by its rotation. Therefore, the outer diameter thereof is gradually reduced by delivering the film 12, and the reduction of the outer diameter can be detected by the position detecting angle sensor 31*f* in the wind-off device 20. Further, the winding film roll 42*a* in the film winding mechanism 42 takes-up the film 12 by its rotation. Therefore, the outer diameter thereof is gradually increased by taking-up the film 12, and the increase of the outer diameter is detected by the position detecting angle sensor 51*f* in the winding device 40. The controller 18 controls each of the wind-off motor 22*c* and the winding motor 42*c* based on the detection output of the position detecting angle sensors 31*f*, 51*f*, and accelerates the rotation speed of the wind-off film roll 22*a* as the outer diameter of the wind-off film roll 22*a* is reduced, and the rotation speed of the winding film roll 42*a* is delayed as the outer diameter of the winding film roll 42*a* is increased. Thus, the amount of the delivered film 12 and the amount of the taken-up film 12 can be always constant, irrespective of the change of the outer diameter of the wind-off film roll 22*a* and the winding film roll 42*a*.

Further, the amount of the film 12 taken-up by the winding device 40 by rotating the third fixed roller 44 previously calculated number of times, the amount of the film 12 accumulated by the winding and accumulating mechanism 43 in synchronization with take-up of the film 12, and the amount of the film 12 delivered by the delivering and accumulating mechanism 23 in a short period of time, are mathematically same, thus having no influence on the tension of the film 12 during carrying the film 12. Further, even if error is generated in these amounts, the error is absorbed by moving each dancer roller 31*d*, 51*d* in the wind-off and winding tension devises 31, 51 by the added force of each spring 31*e*, 51*e*, or against the added force. Therefore, in the present invention, the predetermined amount of film can be speedily carried in each predetermined time, with no influence on the tension of the film 12.

Figure 8:
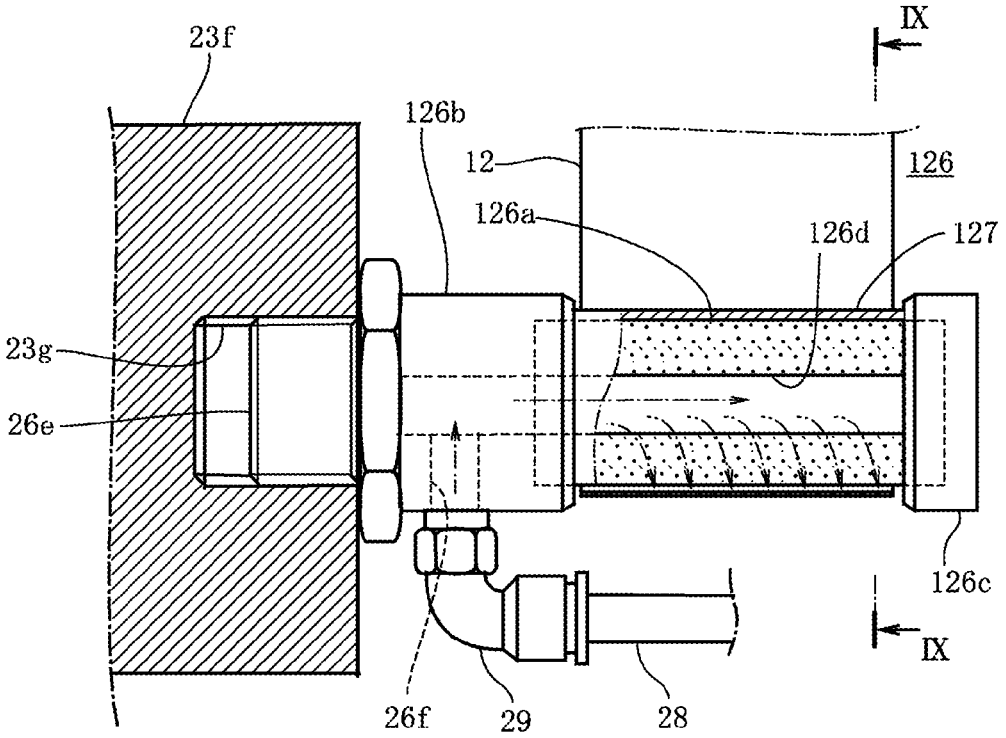
FIG. 8 is a cross-sectional view showing a structure of another movable roller corresponding to FIG. 4.
Figure 9:
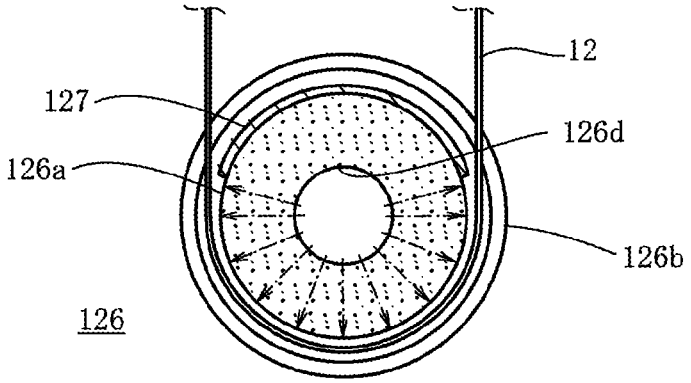
FIG. 9 is a cross-sectional view taken along the line IX-IX in FIG. 8.

Note that in the aforementioned embodiment, the rollers 25, 26, 44, 46 having the cylinder portions 25*a*, 26*a*, and 44*a* provided with a plurality of air holes 25*k*, 26*k*, 44*k*, with one end communicated with the through holes 25*d*, 26*d*, 44*d*, are shown as the rollers 25, 26, 44, 46 around which the film 12 is wound in a state of being floated from the outer periphery or in a state of being adsorbed on the outer periphery. However, the air holes 25*k*, 26*k*, 44*k* provided in the cylinder portions 25*a*, 26*a*, and 44*a* are not required to be formed as long as the film 12 wound around the roller can be floated or can be sucked. FIG. 8 and FIG. 9 show another upstream-side movable roller 126, and such another upstream-side movable roller 126 will be representatively described hereafter. It is also acceptable that a cylinder portion 126*a* is formed by a porous material and non-woven fabric, etc., through which the air can be passed to the outer peripheral surface from the through hole 126*d*, and wall members 126*b*, 126*c* are bonded to both sides of the cylinder portion 126*a*.

In this case, it can be considered that the wall members 126*b*, 126*c* are formed by metal or resin through which the air cannot be passed, and the outer peripheral portion of the cylinder portion 126*a* around which the film 12 is not wound, is sealed by a sealing member 127. Even in a case of such a roller 126, the compressed air supplied to the through hole 126*d* is passed through the cylinder portion 126*a* not sealed by the sealing member 127 from the through hole 126*d* as shown by one dot chain arrow, and is blown-out from the outer periphery around which the film 12 is wound as shown by arrow, so that the film 12 wound around the cylinder portion 126*a* can be floated. Then, the movement of the film 12 in the width direction can be limited by the wall members 126*b*, 126*c*, which is the film 12 wound around the cylinder portion 126*a* in a floated state. Further, flow of the air toward the through hole 126*d* from the outer periphery of the cylinder portion 126*a* is generated by sucking the air through the through hole 126*d*, and the film 12 wound around the cylinder portion 126*a* can be adsorbed on the outer periphery of the cylinder portion 126*a*.

Further, in the aforementioned embodiment, explanation is given for a case that the self-rotation type roller with the film 12 wound around the outer periphery in a contact state, is used as the wind-off side deflecting roller 20*a*, the first fixed roller 24, the winding-side deflecting roller 40*a*, and the fourth fixed roller 45. However, the roller may be either such rollers 20*a*, 24, 40*a*, 45, or the roller around which the film 12 is wound in a state of being floated by the air supplied thereto.

Further, the aforementioned embodiment shows a case that, a pair of guide rollers 31*a*, 31*b* and the dancer roller 31*d* in the wind-off tension adding device 31, are the self-rotation type rollers around which the film 12 is wound for carrying the film 12 while being deflected by the rotation of these rollers themselves, and a pair of guide rollers 51*a*, 51*b* and the dancer roller 51*d* in the winding tension adding device 51 are also the self-rotation type rollers around which the film 12 is wound for carrying the film 12 while being deflected. However, it is also acceptable to use the rollers 31*a*, 31*b*, 31*d*, 51*a*, 51*b*, 51*d* as the rollers around which the film 12 is wound in a floated state by the air supplied thereto.

Figure 10:
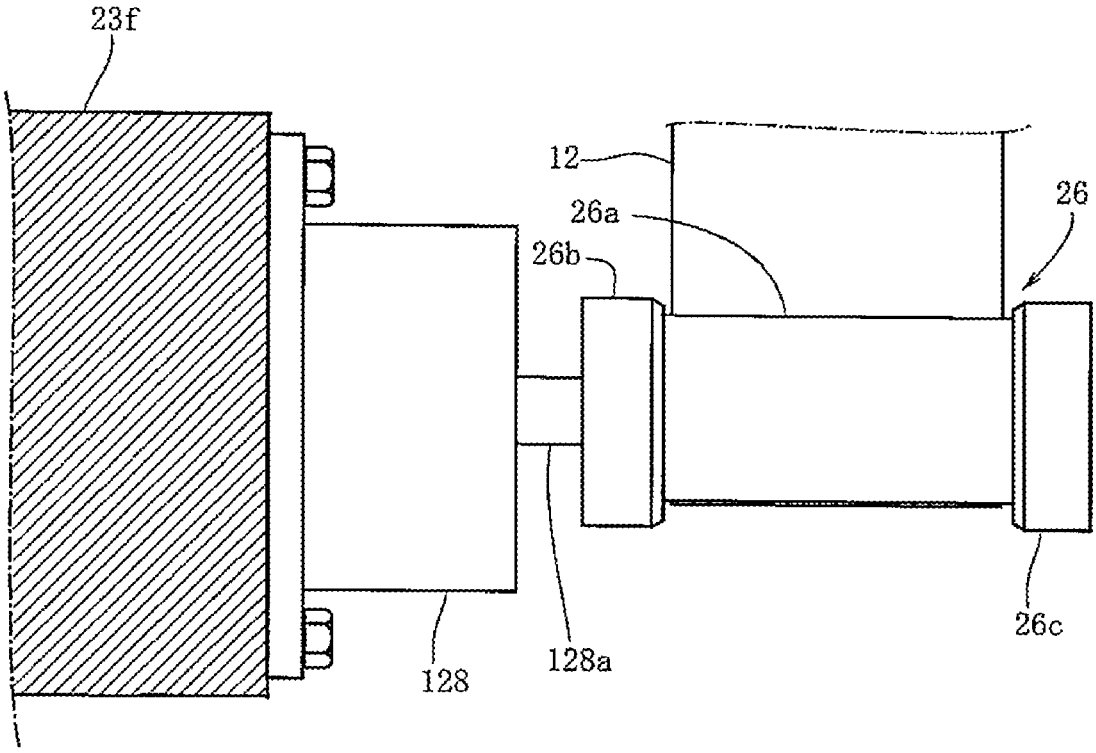
FIG. 10 is a view showing a movable roller rotated by a servo motor corresponding to FIG. 4.

Further, the aforementioned embodiment shows a case that the friction preventive unit is the compressed air supply pump 27 for supplying the compressed air to the second fixed roller 25, the upstream-side movable roller 26, and the downstream-side movable roller 46, to thereby float the film 12 wound around these rollers 25, 26, 46 from the outer periphery of the rollers 25, 26, 46. However, the friction preventive unit may also be the servo motor for forcibly rotating the rollers 25, 26, 46. FIG. 10 shows a servo motor 128 for rotating the upstream-side movable roller 26. Explanation will be given for the servo motor 128 representatively for rotating the upstream-side movable roller 26. The servo motor 128 is attached to the wind-off side movable base 23*f*, and the upstream-side movable roller 26 is coaxially attached to a rotary shaft 128*a* thereof. Then, the control output of the controller 18 (FIG. 1) is connected to the servo motor 128, and the controller 18 is configured to control the servo motor 128 so that the speed on the outer periphery coincides with the carrying speed of the film 12 wound around the upstream-side movable roller 26, by the rotation of the upstream-side movable roller 26.

In the friction preventive unit formed of the servo motor 128, rubbing of the film 12 against the outer periphery of the rollers 25, 26, 46 can be prevented by forcibly rotating the rollers 25, 26, 46 so that the speed on the outer periphery of the rollers 25, 26, 46 coincides with the carrying speed of the film 12 which is wound around the outer periphery of the rollers 25, 26, 46, thus not allowing the friction to occur which is caused by such rubbing.

Here, the second fixed roller 25, the upstream-side movable roller 26 and the downstream-side movable roller 46 have respectively a lighter weight than the weight of each film roll 22*a*, 42*a* around which the film 12 is wound in a roll shape, and the inertia force added thereon is smaller compared with a case that the rotation of the film rollers 22*a*, 42*a* is accelerated. Therefore, even in a case that the servo motor 128 for forcibly rotating the rollers 25, 26, 46 is used as the friction preventive unit, the servo motor 128 is capable of rotating the rollers 25, 26, 46 so as to coincide with the carrying speed of the film 12 which is intermittently carried. Accordingly, even in a case of using the servo motor 128 as the friction preventive unit, the carrying speed of the film 12 can be sufficiently increased without generating the scratches, etc., on the film 12 which is intermittently carried. Further, regarding the friction preventive unit as the servo motor 128, as shown in FIG. 10, a relatively inexpensive general roller provided with the wall members 26*a*, 26*c* at both sides of the cylinder portion 26*a* for limiting the movement of the film 12 in the width direction, can be used as the rotating rollers 25, 26, 46.

Further, according to the aforementioned embodiment, the third fixed roller 44 is formed rotatable, with the film 12 adsorbed thereon, and the friction is not allowed to occur between the film 12 and the second fixed roller 25. However, it is also acceptable that the second fixed roller 25 is formed rotatable with the film 12 adsorbed thereon, and the friction is not allowed to occur between the film 12 and the third fixed roller 44. Further, as long as intermittent carrying of the film 12 is enabled for a predetermined carrying amount, it is also acceptable that the friction is not allowed to occur between the film 12 wound around the second and third fixed rollers 25, 44, and the second and third fixed rollers 25, 44, using the compressed air supply pump 27 or the servo motor 128.

The invention claimed is:

1. A film intermittent carrying device for a predetermined processor, comprising:

a film delivery mechanism configured to deliver a film constantly at a specified rate to the predetermined processor;

a delivering and accumulating mechanism configured to accumulate the film which is delivered from the film delivery mechanism and discharge the film;

a winding and accumulating mechanism configured to accumulate the film in an amount corresponding to an amount of the film discharged by the delivering and accumulating mechanism, while simultaneously discharging the film; and a film winding mechanism configured to take up the film constantly at the specified rate, with this film being discharged from the winding and accumulating mechanism after being processed by the predetermined processor;

wherein the film delivery mechanism and the delivering and accumulating mechanism are disposed on an upstream side of the predetermined processor while the winding and accumulating mechanism and the film winding mechanism are disposed on a downstream side of the predetermined processor, with respect to a flow of the film;

the delivering and accumulating mechanism comprises:

first and second fixed rollers provided along a carrying route of the film;

an upstream-side movable roller mounted for translating in a direction perpendicular to a plane of the film moving along the carrying route while passing through a middle position between the first and second fixed rollers; and an upstream-side friction preventive unit configured to suppress a friction from occurring between the film, which is wound around the upstream-side movable roller, and the upstream-side movable roller; and the winding and accumulating mechanism comprises:

third and fourth fixed rollers provided along the carrying route of the film;

a downstream-side movable roller mounted for translating in a direction perpendicular to the plane of the film moving along the carrying route while passing through the middle position between the third and fourth fixed rollers; and a downstream-side friction preventive unit configured to suppress a friction from occurring between the film, which is wound around the downstream-side movable roller, and the downstream-side movable roller;

wherein:

one of said second and third fixed rollers is formed as a rotatable roller, with the film wound therearound being adsorbed on the rotatable roller, the film intermittent carrying device further comprises:

a winding servo motor configured to rotate the rotatable roller to prevent sliding friction from being generated between the rotatable roller and the film wound around and adsorbed thereon; and a carrying-side friction preventive unit not allowing a friction to occur between the rotatable roller and the film wound around the rotatable roller;

a compressed air supply pump forms said upstream-side friction preventive unit, said downstream-side friction preventive unit, and said carrying-side friction preventive unit.

2. The film intermittent carrying device according to claim 1, wherein the upstream-side and downstream-side friction preventive units include a compressed air supply pump for floating the film wound around the upstream-side and downstream-side moveable rollers from an outer periphery of the upstream-side and downstream-side moveable rollers by supplying compressed air to the upstream-side and downstream-side moveable rollers.

3. The film intermittent carrying device according to claim 1, wherein each of the upstream-side and downstream-side friction preventive units include a servo motor for rotating a corresponding roller so that a speed on the outer periphery of the rotating corresponding roller coincides with a carrying speed of the film wound around the corresponding roller.

4. The film intermittent carrying device according to claim 1, further comprising a film adsorbing mechanism including air holes radially formed in the rotatable roller to suck the film wound around the rotatable roller to be adsorbed thereon.

* * * * *